US005871381A

United States Patent [19]

Lin

[11] Patent Number: 5,871,381

[45] Date of Patent: Feb. 16, 1999

[54] STATOR OF PROPELLING SYSTEM OF SMALL POWERBOAT

[76] Inventor: Yeun-Junn Lin, 5F, No. 23, Lane 10, Tian Bao Street, Taichung, Taiwan

[21] Appl. No.: 896,066

[22] Filed: Jul. 17, 1997

[30] Foreign Application Priority Data

Jun. 27, 1997 [TW] Taiwan ..... 862210642

[51] Int. Cl.[6] ..... B63H 11/08

[52] U.S. Cl. ..... 440/38; 440/47

[58] Field of Search ..... 440/38–40, 42, 440/47; 60/221, 222

[56] References Cited

U.S. PATENT DOCUMENTS 3,839,859 10/1974 Woell, Jr. ..... 440/38

FOREIGN PATENT DOCUMENTS 128993 5/1990 Japan ..... 440/47

*Primary Examiner*—Ed L. Swinehart

*Attorney, Agent, or Firm*—Browdy and Neimark

[57] ABSTRACT

A motorboat propelling system is composed of a water current channel in which a propeller and a stator are located. The channel is provided at a head end thereof with a water inlet and at a tail end thereof with a propelling nozzle. The stator has an axial portion divided into a front section contiguous to the propeller and a rear section contiguous to the nozzle. The front section has an outer diameter becoming progressively smaller towards one end thereof contiguous to the propeller, whereas the rear section has an outer diameter becoming gradually smaller towards one end thereof contiguous to the propelling nozzle.

4 Claims, 4 Drawing Sheets

STATOR OF PROPELLING SYSTEM OF SMALL POWERBOAT

FIELD OF THE INVENTION

The present invention relates generally to a powerboat propelling system, and more particularly to a stator of the powerboat propelling system.

BACKGROUND OF THE INVENTION

As shown in FIG. 1, the conventional propelling system of a small powerboat is generally composed of a hull 10, an engine 12 housed in the hull 10, a shaft 13 driven by the engine 12, a channel 11 located in the hull 10 such that one end of the shaft 13 is extended into the channel 11, an impeller 14 fastened with the shaft 13, and a stator 15 located in the channel 11 and behind the impeller 14. The stator 15 has an axial portion 151 and a plurality of guide blades 152 mounted on the axial portion 151.

The shaft 13 is driven by the engine 12 to actuate the impeller 14 for compressing the water current in the channel 11. As the vortex water current is allowed to pass the stator 15, the vortex current is changed to move forward linearly and rapidly towards a nozzle 111 so as to generate a powerful thrust to propell the hull 10. In order to enhance the thrust effect of the nozzle 111, the nozzle 111 is funnel-shaped such that its internal cross-sectional area is made smaller, and that it is capable of accelerating the flow speed of the water current in conformity with the Bernoulli equation. However, it must be pointed out the fact that the nozzle 111 of the conventional thrust system described above is limited in design in its practical application in the motorboat. In other words, when the nozzle 111 is shortened in view of the design consideration, the inner wall of the shortened nozzle 111 is highly vulnerable to severe impact of the water current. On the other hand, when the nozzle 111 is lengthened, the overall length of the hull 10 must be increased accordingly so as to accommodate the lengthened nozzle 111.

SUMMARY OF THE INVENTION

It is therefore the primary objective of the present invention to provide a motorboat propelling system with a stator capable of improving the thrust effect of the motorboat propelling system without having to redesign the water channel and the nozzle of the motorboat propelling system.

It is another objective of the present invention to provide a motorboat propelling system with a stator capable of inducing an acceleration of water flow in the water channel of the motorboat propelling system.

In keeping with the principle of the present invention, the foregoing objectives of the present invention is attained by a stator, which is located in the channel of the motorboat propelling system and is provided in the axial portion thereof with a front section and a rear section. The front section becomes larger diametrically and progressively from one end thereof towards another end thereof. The rear section becomes smaller diametrically and progressively from one end thereof towards another end thereof. The front section and the rear section are connected such that the diametrically largest portions of the front section and the rear section meet, and that the water flow space located between the inner wall of the channel and the outer wall of the stator is progressively made smaller from one end to another, so as to lengthen the acceleration range of the water current passing through the outer wall of the stator for promoting the thrust effect of the propelling system on the motorboat hull.

The foregoing objectives, features, functions and advantages of the present invention will be more readily understood upon a thoughtful deliberation of the following detailed description of the embodiment of the present invention with reference to the accompanying drawings.

DETAILED DESCRIPTION OF THE INVENTION

Figure 1:
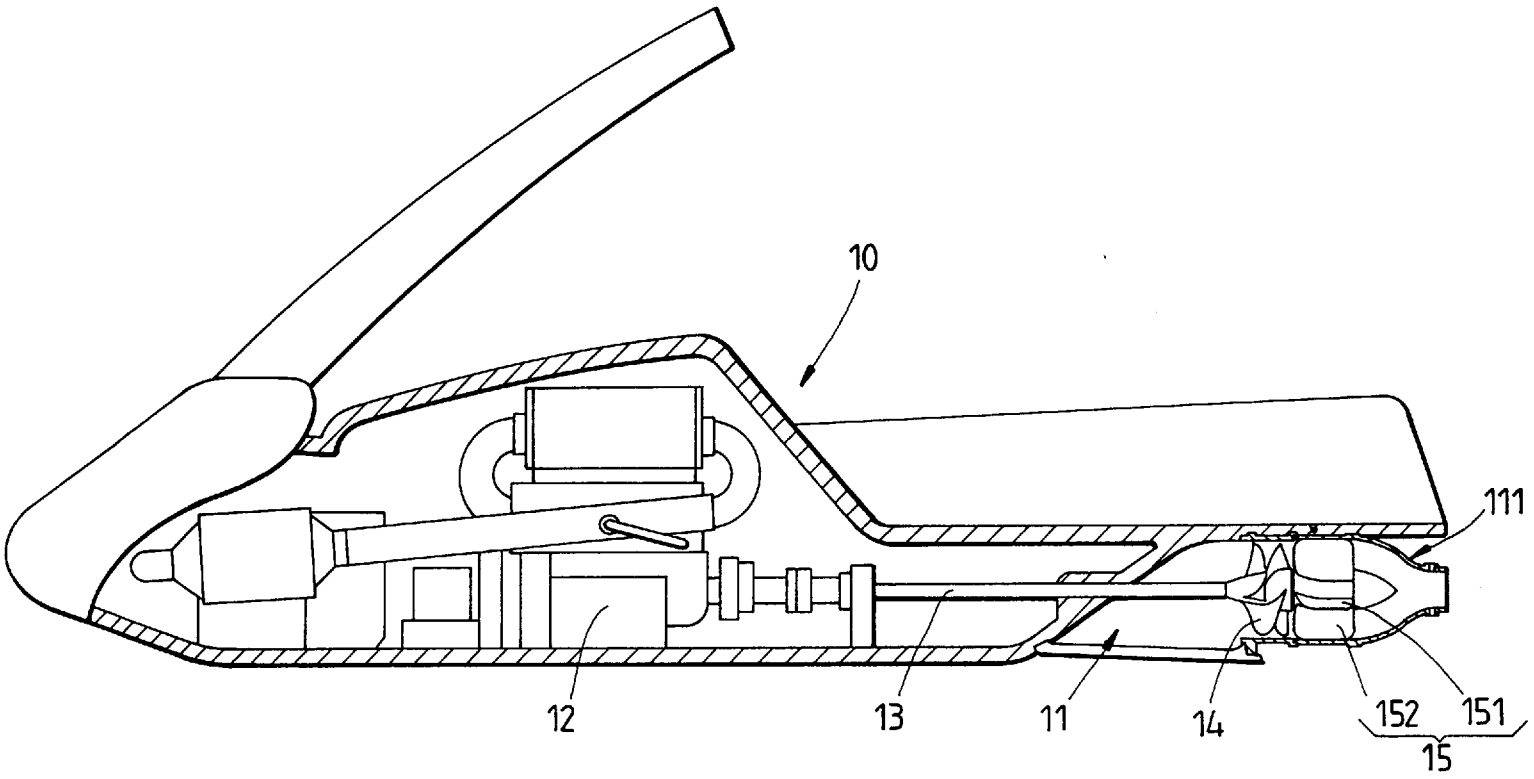
FIG. 1 (PRIOR ART)
FIG. 1 shows a schematic view of a motorboat propelling system of the prior art.
Figure 2:
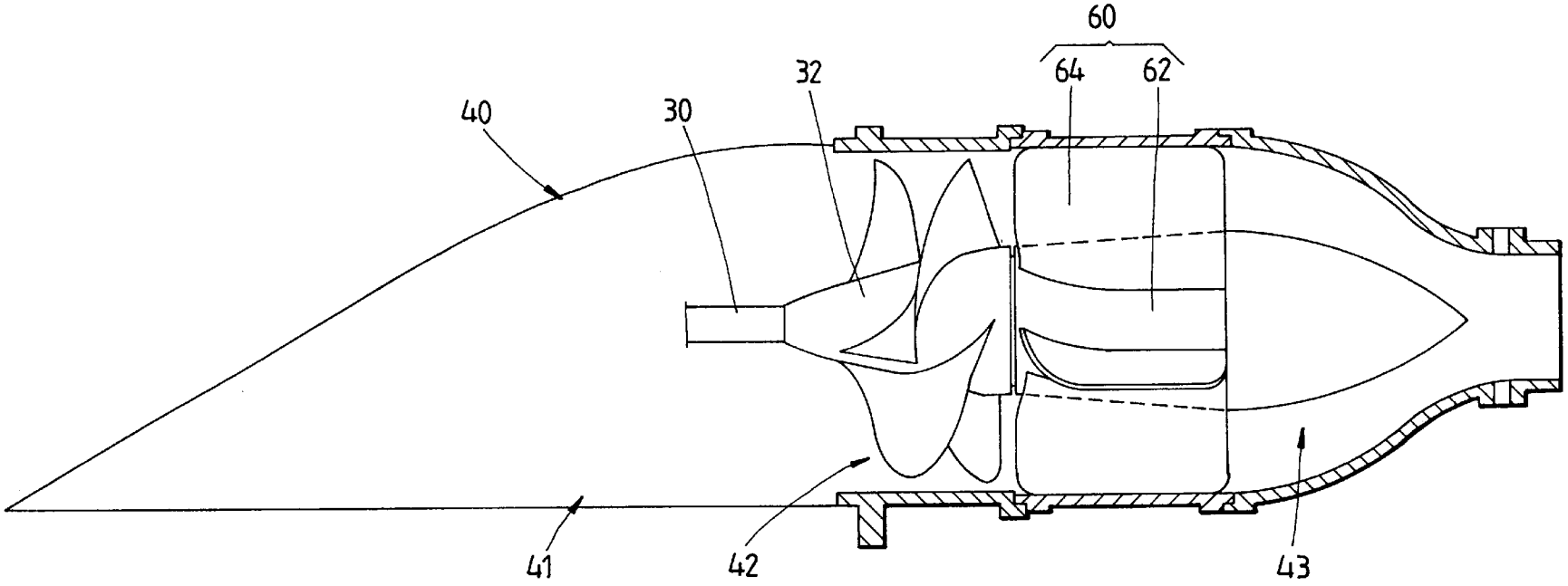
FIG. 2 shows a sectional schematic view of a preferred embodiment of the present invention.
Figure 3:
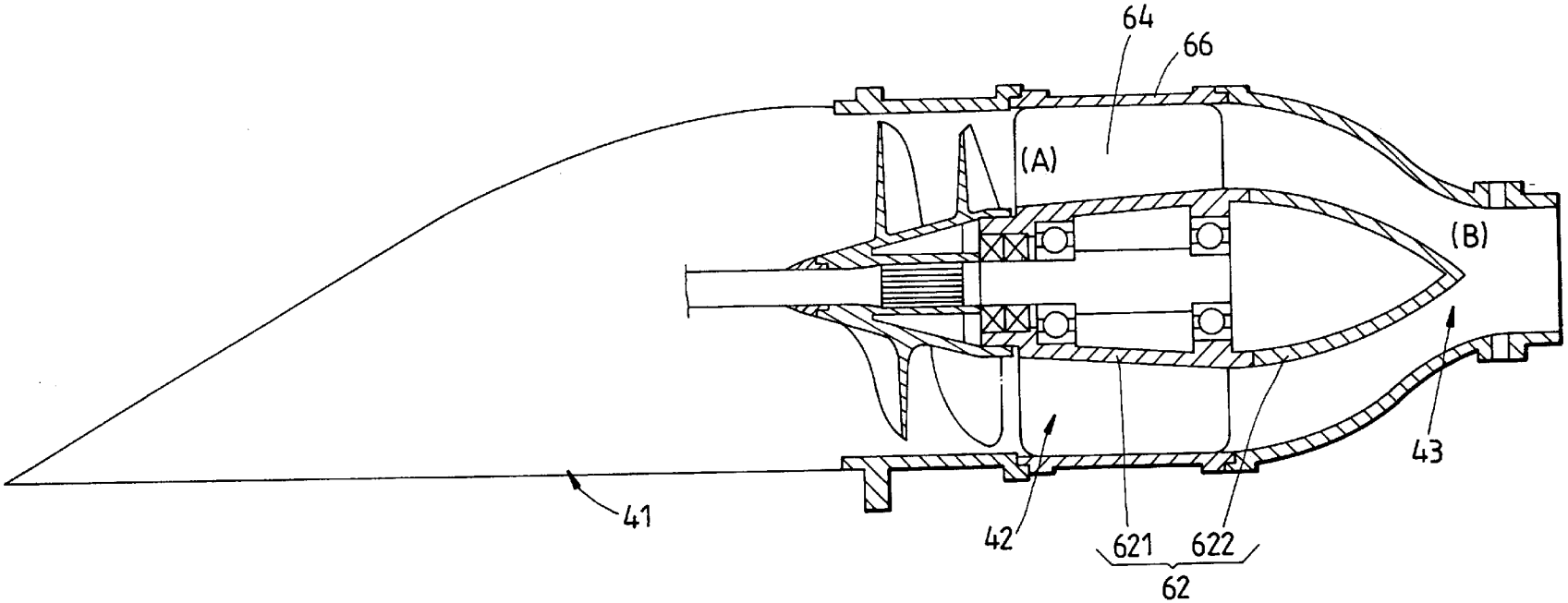
FIG. 3 shows another sectional schematic view of the preferred embodiment of the present invention.

As shown in FIGS. 2 and 3, a motorboat propelling system of the present invention is intended to cooperate with a channel 40 of a motorboat hull (not show in the drawing).

The channel 40 has one end extending to reach the bottom of the motorboat hull to form an inlet 41, and another end extending to reach the tail end of the hull to form a funneled nozzle 43. Located between the inlet 41 and the nozzle 43 is a straight midsegment 42 of the channel 40.

The motorboat propelling system comprises an engine (not shown in the drawing), a shaft 30 having one end driven by the engine and having another end extending to reach the midsegment 42 of the channel 40, a propeller 32 fastened with the rear end of the shaft 30, and a stator 60 located in the midsegment 42 and the nozzle 43 for guiding the water current.

The stator 60 has an axial portion 62 and a plurality of guide blades 64 of a curved construction.

In operation, the propeller 32 is actuated by the shaft 30 which is driven by the motor. The water current is compressed in the channel 40 by the propeller 32 in motion. The compressed water is then allowed to pass through the stator 60 for correction in the direction in which the water flows. The thrust is generated at the time when the water is discharged via the nozzle 43. The motorboat is propelled by the thrust.

The axial portion 62 of the stator 60 consists of a front section 621 and a rear section 622. The front section 621 is located in the midsegment 42 of the channel 40 while the rear section 622 is located in the nozzle 43. The front section 621 is tapered such that the open space formed between the inner wall of the channel 40 and the outer wall of the front section 621 becomes progressively smaller towards the rear section 622, which has an outer diameter becoming gradually smaller towards the nozzle 43. In other words, the juncture which is located outside of frame, at which the front section 621 and the rear section 622 meet, has the largest outer diameter.

Figure 4:
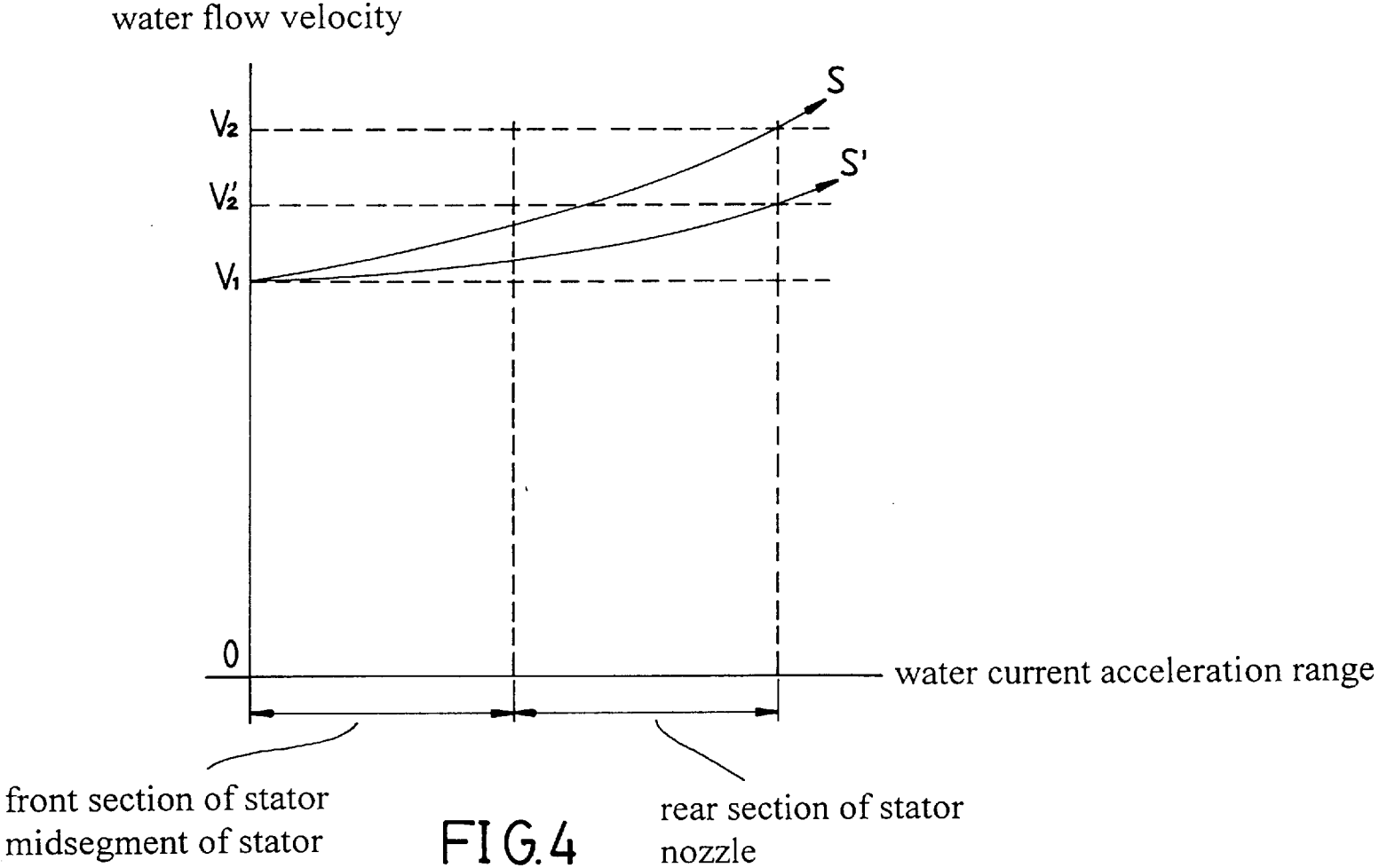
FIG. 4 shows a comparison of the present invention with the prior art as shown in FIG. 1.

As illustrated in FIG. 4, the motorboat propelling system provided with the stator 60 of the present invention is more efficient than the motorboat propelling system provided with the prior art stator. In other words, the thrust "S" generated by the present invention is greater than the thrust "S'" generated by the prior art, in view of the fact that the nozzle water current velocity "$V_2$" of the present invention is greater than the nozzle water current velocity "$V_2$'" of the prior art. The flow velocity of the water current in the channel 40 is effectively accelerated by the propeller 322 and the stator 60 from the point (A) of the midsegment 42 of the front section 621 to the point (B) of the nozzle 43, as illustrated in FIG. 3. According to the Bernoulli equation, the effect of the present invention can be expressed in terms of the equation, $V_2^2=V_1^2+2\ a\ s$ , in which $V_2$ is the nozzle water current velocity; $V_1$, the initial flow velocity of the water current entering the midsegment 42 of the channel 40; a, the acceleration effected on the water current by the propeller in motion; and s, the acceleration range of the water current. As shown in FIG. 4, the initial flow velocity $V_1$ of the present invention is the same as the initial flow velocity $V_1$ of the prior art. However, the flow velocity of the water current is accelerated by the stator 60 of the present invention such that the flow velocity $V_2$ at the point (B) of the nozzle 43 of the present invention is greater than the flow velocity $V_2$' of the prior art. As a result, the thrust S generated by the present invention is greater than the thrust S' brought about by the prior art propelling system.

Without modifying the prior art stator, the effort made to modify the construction of the nozzle to achieve the similar result of the present invention is in fact technically infeasible. For example, a reduction in the inner diameter of the outer end of the nozzle can result in a reduction in the thrust, in view of the fact that the water current is somewhat obstructed by the steep inner wall of the downsized nozzle.

As shown in FIG. 3, the stator 60 of the present invention is located in the channel 40 by means of a frame 66, which is capable of holding securely the axial portion 62 of the stator 60 in the axial area of the channel 40. In other words, the frame 66 is in fact an integral part of the channel 40. The guide blades 64 are made integrally with the frame 66 such that they are corresponding in location to the front section 621 of the axial portion 62 of the stator 60.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A motorboat propelling system comprising:

a water current channel located in a motorboat hull such that said water current channel is provided at a head end thereof with a water inlet and at a tail end thereof with a nozzle;

an engine provided with a shaft fastened therewith such that said shaft is driven by said engine, and that a free end of said shaft is located in said water current channel;

a propeller fastened with said free end of said shaft for impelling water current entering said water current channel through said water inlet; and a stator secured in said water current channel such that said stator is located between said propeller and said nozzle, and that said stator and an inner wall of said channel form therebetween an open space passable by the water current;

wherein said stator has an axial portion, which is divided into a front section nearest to said propeller and a rear section nearest to said nozzle, said front section having an outer diameter becoming progressively smaller towards a first end thereof nearest to said propeller, whereas said rear section having an outer diameter becoming progressively smaller towards a second end thereof nearest to said nozzle;

wherein said water current channel is provided with a cylindrical frame made integrally therewith such that said frame has a plurality of guide blades; and wherein said stator is secured in said water current channel such that said stator is located by said guide blades said frame.

2. The motorboat propelling system as defined in claim 1, wherein said stator is located by said frame such that said front section of said stator is secured by said guide blades of said frame.

3. The motorboat propelling system as defined in claim 1, wherein a largest diameter of said stator is located outside said cylindrical frame toward said nozzle.

4. The motorboat propelling system as defined in claim 2, wherein said guide blades are curved.

* * * * *